US010079127B1

(12) United States Patent
Holland et al.

(10) Patent No.: US 10,079,127 B1
(45) Date of Patent: Sep. 18, 2018

(54) CONTACT ARM SHIELDS, SHIELDED CONTACT ARM ASSEMBLIES, AND CONTACT ARM PROTECTION METHODS

(71) Applicant: Siemens Industry, Inc., Alpharetta, GA (US)

(72) Inventors: Thomas William Holland, Flowery Branch, GA (US); Mario Munoz, Buford, GA (US); Jesus Hernandez, Suwanee, GA (US); Brian Timothy McCoy, Lawrenceville, GA (US); Timothy Biedrzycki, Powder Springs, GA (US)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 0 days.

(21) Appl. No.: 15/617,095

(22) Filed: Jun. 8, 2017

(51) Int. Cl.
*H01H 33/08* (2006.01)
*H01H 71/02* (2006.01)

(52) U.S. Cl.
CPC ..... *H01H 33/08* (2013.01); *H01H 71/02* (2013.01); *H01H 2235/01* (2013.01)

(58) Field of Classification Search
CPC ..... H01H 33/08; H01H 33/02; H01H 71/02; H01H 9/32; H01H 9/341; H01H 9/34
USPC ..... 218/147, 41, 77, 136; 200/244, 275
See application file for complete search history.

(56) References Cited

U.S. PATENT DOCUMENTS

| | | | | |
|---|---|---|---|---|
| 4,431,877 | A * | 2/1984 | Heft | H01H 71/121 200/304 |
| 4,716,265 | A * | 12/1987 | Fujii | H01H 73/18 200/305 |
| 5,073,764 | A * | 12/1991 | Takahashi | H01H 1/2066 335/16 |
| 5,326,947 | A * | 7/1994 | Edds | H01H 9/34 218/1 |
| 8,119,947 | B2 | 2/2012 | Yang | |
| 8,901,446 | B2 | 12/2014 | Fong et al. | |
| 9,530,592 | B1 | 12/2016 | Blankemeyer | |
| 2012/0199449 | A1 | 8/2012 | Fong et al. | |
| 2016/0181045 | A1 * | 6/2016 | Gates | H01H 71/1027 200/330 |

FOREIGN PATENT DOCUMENTS

WO 2013130035 A1 9/2013

* cited by examiner

*Primary Examiner* — Renee Luebke
*Assistant Examiner* — William Bolton

(57) ABSTRACT

An arc shield apparatus for an electrical switching device. Arc shield apparatus includes a body having an abutting portion including a first side configured to abut against a lateral side of a contact arm of an electrical switching device, and a second side opposite from the first side, an aperture passing between the first and second side, the aperture configured to receive a spring tab of the contact arm therein, and an arc shield including a first shield portion extending from the first abutting portion, the first shield portion including a first contact surface configured to abut against a contact arm edge, and a second shield portion configured to shield at least some of the spring tab and spring hook. Shielded contact arm assemblies and methods of protecting a contact arm of an electrical switching device during an arcing event, are disclosed, as are other aspects.

16 Claims, 6 Drawing Sheets

*"Prior Art"*

*"Prior Art"*

CONTACT ARM SHIELDS, SHIELDED CONTACT ARM ASSEMBLIES, AND CONTACT ARM PROTECTION METHODS

FIELD

The present disclosure relates to arc shields for contact arms of electrical switching apparatus, and more particularly to arc shields for electrical circuit breakers.

BACKGROUND

Devices for electrical switching, such as circuit breakers, may need to survive a fault or short-circuit conditions, in which the electrical current through the device may be many times larger than the device's continuous current rating (the so-called rated current or handle rating). If such a fault current lasts even a few seconds, the conductive parts (e.g., electrical contacts) of the electrical device may be degraded or even melt to some extent. Debris and arcing may also possibly damage other device components that are in the vicinity of the electrical contacts.

One prior art remedy used to protect components has been to wrap a part of the contact arm 401 and to separately wrap the spring hook 403SH of the contact spring 403 of the electrical device with a fiberglass cloth 401C as shown in FIG. 4A. However, this is an expensive and labor intensive process, wherein an operator manually precuts and wraps the fiberglass cloth and wraps it onto the contact arm 401 and spring hook 403SH.

Furthermore, the fiberglass cloth 401C may become unraveled in some instances possibly causing other potential interferences (e.g., lodging between the contacts). Moreover, the fiberglass cloth 401C may not provide suitable protection in some respects. For example, the fiberglass cloth wrapping position on the contact arm 401 and the spring hook 403SH may not be consistent (e.g., may be operator dependent), and may leave one or more gaps exposing the contact arm 401 and/or spring tab 401ST to the electrical arc and debris. Moreover, the spring hook 403SH may be exposed. Further, the fiberglass cloth 401C may provide a relatively low degree of protection, as it may rapidly vaporize when contacted by an arc.

Another remedy utilized in the prior art is to include a stainless steel shielding apparatus 401SS as shown in FIG. 4B. However, the stainless steel shielding apparatus 401SS is electrically conductive. Therefore, the electrical arc can cause premature damage to it reducing the protection to the contact arm 401 and/or the spring hook 403SH. Moreover, because of difficulties in forming stainless steel, there may be relatively large gaps left open thus exposing the contact arm 401 and/or the spring hook 403SH to the electrical arc. Further, the stainless steel shielding apparatus 401SS involves a secondary operation to secure it in place (e.g., riveting) wherein a rivet 401R connects the stainless steel shielding apparatus 401SS to the contact arm 401. This riveting may weaken the contact arm 401 as the riveting operation may involve a hole (not shown) to be formed therein.

Thus, there is a need for improved shielding apparatus and shielded contact arm assemblies configured for use in electrical switching devices, such as circuit breakers.

SUMMARY

In a first embodiment, an arc shield apparatus for a contact arm is provided. The arc shield apparatus includes a body including: an abutting portion including a first side configured to abut against a lateral side of a contact arm of an electrical switching device, and a second side opposite from the first side, an aperture passing between the first side and the second side, the aperture configured to receive a spring tab of the contact arm therein; and an arc shield including a first shield portion extending from the first abutting portion, the first shield portion including a first contact surface configured to abut against an edge of the contact arm, and a second shield portion extending from the first abutting portion and configured to shield at least some of the spring tab and spring hook.

In yet another embodiment, a shielded contact arm assembly is provided. The shielded contact arm assembly includes a contact arm including a pivot member on a first end and a moveable electrical contact in a second end, a lateral side, an edge, and a spring tab located between the first end and the second end, an arc shield apparatus including an aperture received over the spring tab, the arc shield apparatus abutting the contact arm at a position proximate to the second end and moveable with the contact arm, and a contact arm spring including a spring hook secured to the spring tab and retaining the arc shield apparatus onto the contact arm, wherein the arc shield apparatus is configured to shield the contact arm and spring hook from arc debris and erosion during an arcing event.

In yet another aspect, an electrical switching apparatus is provided. The electrical switching apparatus includes a molded case, a contact arm including a pivot on a first end and a moveable electrical contact at a second end, and a spring tab between the first end and the second end, an arc shield apparatus received over the spring tab and abutting the contact arm at a position proximate to the second end, and a contact arm spring including a spring hook secured to the spring tab and retaining the arc shield apparatus on the contact arm, wherein the arc shield apparatus is configured to shield the contact arm and spring hook from arc debris and erosion during an arcing event.

In a method embodiment, a method of protecting a contact arm of an electrical switching device during an arcing event is provided. The method includes providing a contact arm having a pivot on a first end and a moveable electrical contact at a second end, and a spring tab between the first end and the second end, providing an arc shield apparatus over the spring tab and abutting the contact arm at a position proximate to the second end wherein the arc shield apparatus is moveable with the contact arm, providing a contact arm spring including a spring hook secured to the spring tab thus retaining the arc shield apparatus on the contact arm, and shielding the contact arm and spring hook from arc debris and erosion with the arc shield apparatus.

Still other aspects, features, and advantages of the present disclosure will be apparent from the following detailed description by illustrating a number of example embodiments, including the best mode contemplated for carrying out the present invention. The present invention may also be capable of different embodiments, and its details may be modified in various respects, all without departing from the scope of the present disclosure. Accordingly, the drawings and descriptions are to be regarded as illustrative in nature, and not as restrictive. The disclosure is to cover all modifications, equivalents, and alternatives falling within the scope of the claims.

DETAILED DESCRIPTION

Figure 1A:
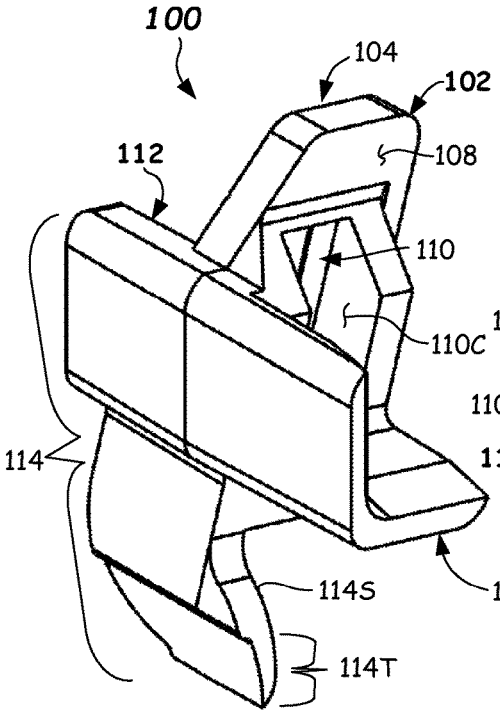
FIGS. 1A-1C illustrate various isometric views of an arc shield apparatus for a moveable contact arm of an electrical switching apparatus according to embodiments.
Figure 1B:
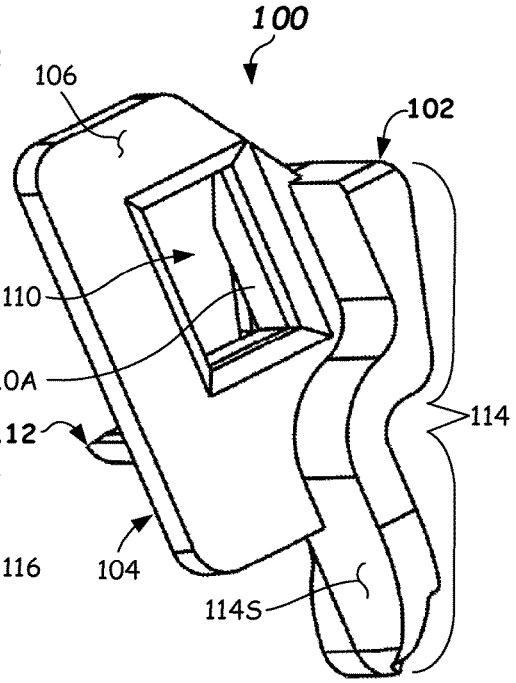
Figure 1C:
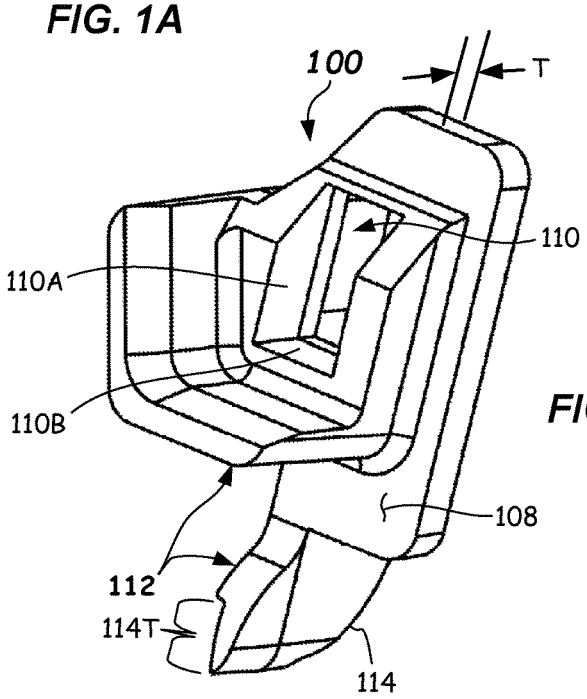

In view of the foregoing difficulties, an improved arc shield apparatus for use on a moveable contact arm of electrical switching apparatus is provided. Embodiments of the disclosure provide an improved arc shield that is configured and adapted to provide enhanced arc protection to the contact arm as well as to the contact arm spring coupled thereto. Moreover, the arc shield construction may protect other parts of the electrical switching apparatus.

In one aspect, the improved arc shield apparatus is a molded polymer component that is installed onto the contact arm over a spring tab and is secured in place by the spring hook of the contact arm assembly engaging with the spring tab of the contact arm. The arc shield apparatus includes integral portions that shield the contact arm and the spring hook and at least portions of the spring body from arcing erosion and debris. Thus, the electrical switching device may have suitable performance even after numerous arcing events, as erosion of and damage to the contact arm, contact arm spring, and other device components may be minimized.

Embodiments of the arc shield apparatus and shielded contact arm assemblies described herein are useful in electrical switching apparatus, such as for electrical circuit breakers and electrical switches that have high amperage ratings, such as handle ratings of about 70 A or more. Embodiments have particular applicability to molded case circuit breakers having handle ratings of between about 70 A-100 A. However, the arc shield apparatus and contact arm assemblies described herein may have applicability to other types of switching devices, such as molded case circuit breakers having handle ratings of even above 100 A.

Embodiments of the arc shield apparatus of the present disclosure may provide one or more advantages, such as being molded to fit closely to a contour of the contact arm thus minimizing the air gaps, designed as a drop-on component that can be readily assembled onto the contact arm, such as by gravity assembly methods, and includes a design feature that facilitates being retained in place by the spring hook of the contact arm spring, and requires no hole in the contact arm for installation.

These and other embodiments of the arc shield apparatus, shielded contact arm assemblies, and methods of protecting a contact arm of an electrical switching device during an arcing event are described below with reference to FIGS. 1A-5 herein.

Referring now in specific detail to FIGS. 1A-1G, an arc shield apparatus 100 is shown. The arc shield apparatus 100 may be used as a subcomponent of a shielded contact arm assembly 200 (FIGS. 2A-2B) within an electrical switching apparatus 300 (FIG. 3), such as electrical circuit breaker, or the like, and in particular a molded case circuit breaker (FIG. 3), which may have a circuit breaker handle rating of greater than 70 A. The arc shield apparatus 100 is configured to be coupled to the contact arm 201 and shield portions of the contact arm 201 as well as the contact arm spring 203 and possibly even other components from damage due to arcing and/or arc debris, such as the spring hook 203SH.

In more detail, the arc shield apparatus 100 includes a body 102, which may be a molded polymer body, which may be made of an inherently flame-retardant material, such as polyphenylene sulfide (PPS). One suitable PPS is RYTON® PPS available from Solvay at Bruxelles, Belgium. The body 102, which may be a molded polymer, may be injection molded, for example. Other methods for molding may be used. The body 102 may include a filler material in some embodiments, such as glass filler. A filling of approximately 30% to 50% glass filler, by weight, may be used.

Figures 2A, 2B:
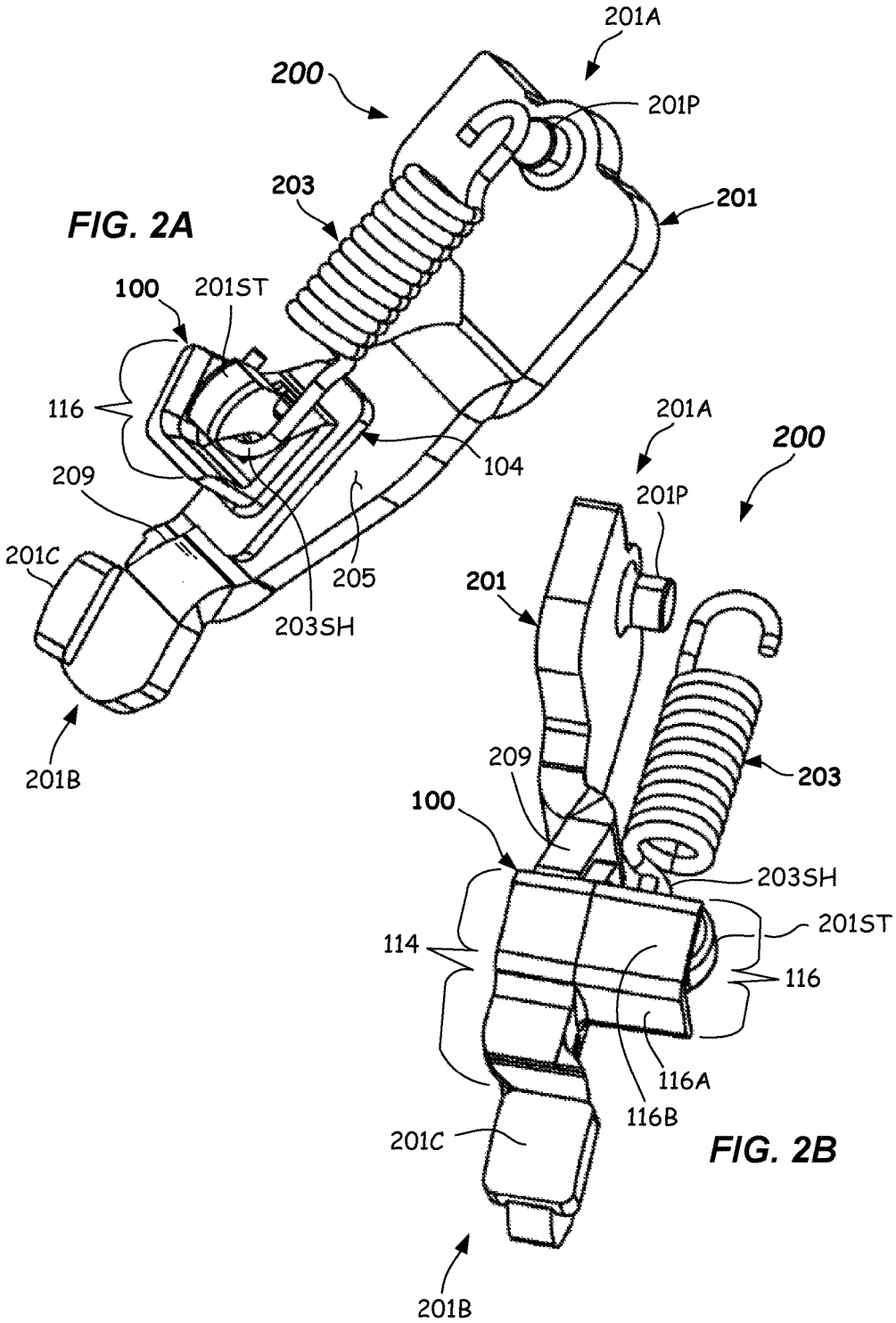
FIG. 2A illustrates a side isometric view of a shielded contact arm assembly according to embodiments.
FIG. 2B illustrates an edge isometric view of the shielded contact arm assembly of FIG. 2A according to embodiments.
Figure 3:
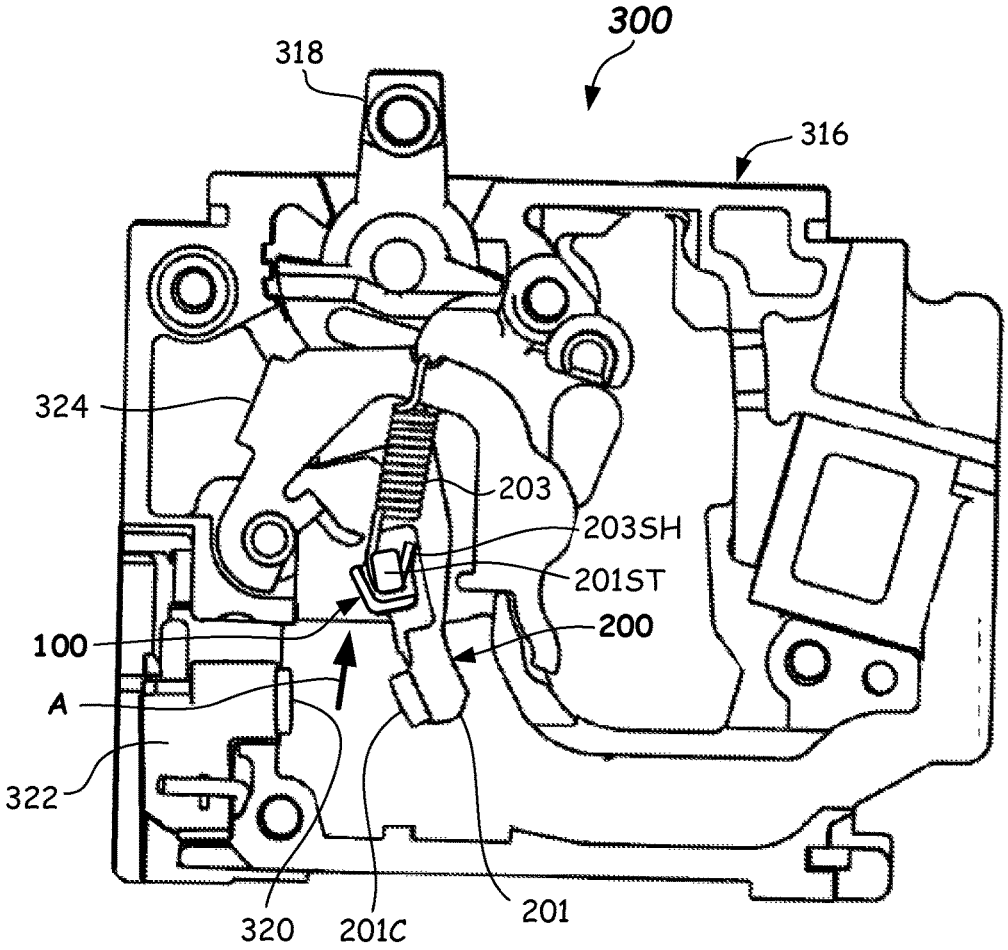
FIG. 3 illustrates a side plan view of a shielded contact arm assembly included in a molded case of an electrical switching apparatus according to embodiments.
Figure 4A:
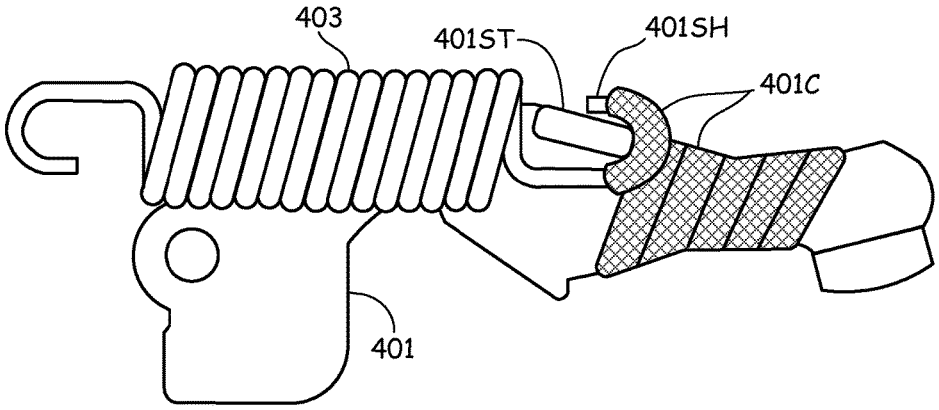
FIG. 4A illustrates a side plan view of a moveable contact arm showing a fiberglass cloth wrapping according to the prior art.
Figure 4B:
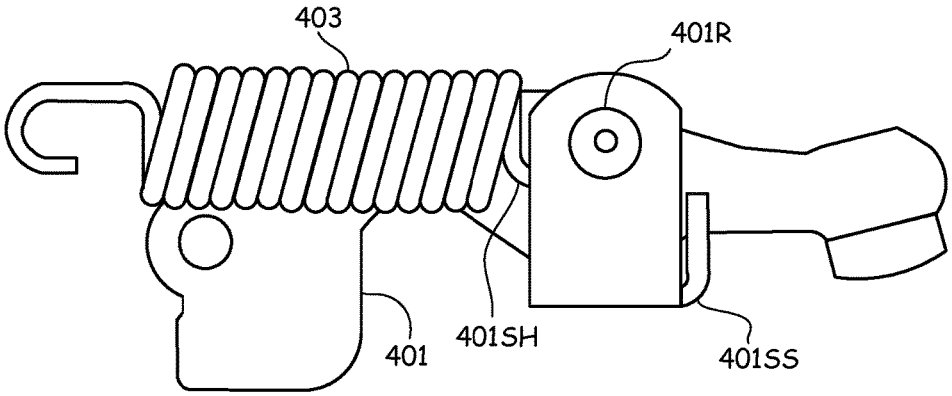
FIG. 4B illustrates a side plan view of a moveable contact arm showing a stainless steel shield riveted to the contact arm according to the prior art.

The body 102 includes an abutting portion 104 that includes a first side 106 that is configured to conform to and/or abut directly against a lateral side 205 of a contact arm 201 (FIGS. 2A-2B) of an electrical switching apparatus 300 (FIG. 3). The first side 106 may comprise a planar surface that directly abuts against a planar surface formed on the lateral side 205 of the contact arm 201. The planar side surface of the lateral side 205 may be at least as long and as wide as a planar surface of the first side 106. As installed on the contact arm 201, the abutting portion 104 is received over the spring tab 201ST, rests in abutting relationship against the lateral side 205, and extends in a direction towards the movable electrical contact 201C in front of the spring tab 201ST and also extends in a direction towards a pivot member 201P behind the spring tab 201ST.

The abutting portion 104 includes a second side 108 opposite from the first side 106. The second side 108 may be co-planar with the first side 106 in some embodiments, and a thickness T (FIG. 1C) of the abutting portion 104 across the co-planar surfaces may be between about 0.5 mm and 1.5 mm, for example. Other suitable thicknesses T may be used. The abutting portion 104 includes an aperture 110 formed in and passing through the abutting portion 104 between the first side 106 and the second side 108. Aperture 110 is sized and configured to receive the spring tab 201ST of the contact arm 201 there through and therein as assembled. The aperture 110 may include a rectangular shape, which may be configured in length and width to slide over the spring tab 201ST leaving only small gaps of less than about 0.5 mm there between, for example. Other gaps may be used. The aperture 110 may include a chamfer or radius surface adjacent the first side 106 to enable ease of insertion of the arc shield apparatus 100 over the spring tab 201ST during assembly. Other aperture shapes may be used. As best shown in FIGS. 1A and 10, the aperture 110 may include extended sidewalls 110A, 1108, 110C that extend above the second side 108. An overall distance between the top surface 110T of the extended sidewalls 110A, 1108, 100C and the first side 106 may be just slightly smaller than the distance between the spring hook mounted location of the spring hook 203SH and the lateral side 205 so that the arc shield apparatus 100 is secured to the contact arm 201 by the spring hook 203SH being mounted on the spring tab 201ST.

The body 102 further comprises a shield 112 including a first shield portion 114 and a second shield portion 116. The first shield portion 214 extends from the abutting portion 104. In particular, the first shield portion 114 may extend perpendicularly from a planar surface of the first side 106 in some embodiments. The first shield portion 114 includes a first contact surface 114S that is configured to abut and shield an edge 209 of the contact arm 201. The first contact surface 214S may be a non-planar surface that is molded and approximately conforms to a shape of the edge 209 of the contact arm 201. The first shield portion 114 may originate at a point approximately even with the aperture 110 and extend forward towards the second end 201B of the contact arm 201 to a location directly proximate to the movable electrical contact 201C.

A forward end of the first shield portion 114 may include tapered end 114T that tapers in thickness to a minimum thickness at a location directly adjacent to the movable electrical contact 201C. In some embodiments, the first shield portion 114 extends to within about 0.1 mm of the electrical contact 201C as shown in FIG. 2B, such that only a small gap is provided there between. A width of the first shield portion 114 may be at least as wide as the width of the edge 209 of the contact arm 201, so that the edge 209 is effectively shielded in use from a location directly adjacent to the movable electrical contact 201C to a location adjacent to the spring tab 201ST.

The arc shield apparatus 100 further includes a second shield portion 116. The second shield portion 116 extends from the abutting portion 104 and is configured to shield at least some of the spring tab 201ST and the spring hook 203SH. Second shield portion 116 may also shield the contact arm spring 203 from arcing and debris during an arcing event. The second shield portion 116 may extend away from the second side 108 in a direction that may be approximately perpendicular to the second surface 208. Second shield portion 116 may include a first shield wall 116A and a second shield wall 116B that may be angularly oriented with respect to one another (See FIG. 2B and FIG. 1D). In particular, the first shield wall 116A may be oriented approximately perpendicularly to a length of the contact arm 201 as installed, and approximately perpendicularly to the path of the arcing and arc debris during use.

Figure 1D:
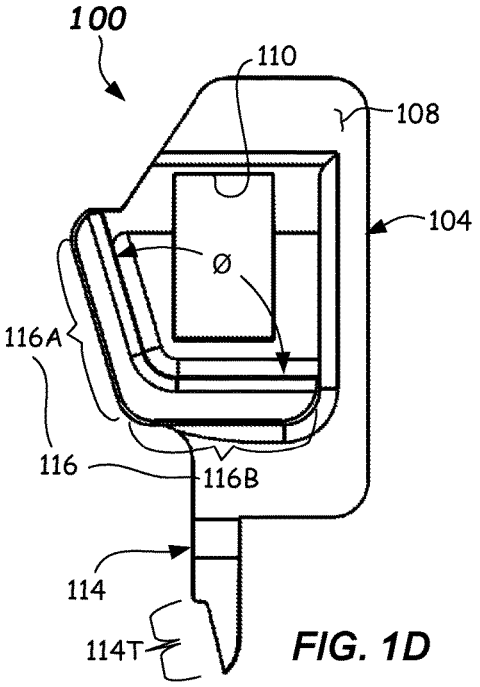
FIG. 1D illustrates a top plan view of an arc shield apparatus according to embodiments.
Figure 1E:
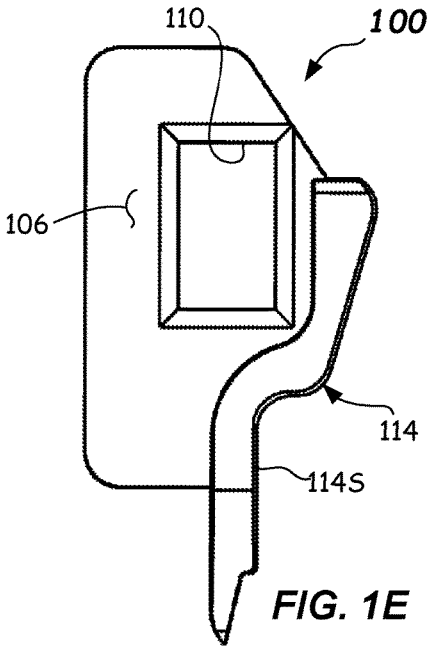
FIG. 1E illustrates a bottom plan view of an arc shield apparatus according to embodiments.

An angular orientation angle $\phi$ between the first shield wall 116A and the second shield wall 116B may be measured as an included angle, as shown in FIG. 1D, between an inside surface of the first shield wall 116A and an inside surface of the second shield wall 116B. Angular orientation angle $\phi$ may be greater than about 90 degrees, and in some embodiments, between about 90 degrees and 130 degrees. More particularly, the angular orientation angle $\phi$ may be between about 100 degrees and 120 degrees. The second shield wall 116B may function as a deflector wing such that arcing and arc debris may be deflected away from any components positioned behind it.

Figure 1F:
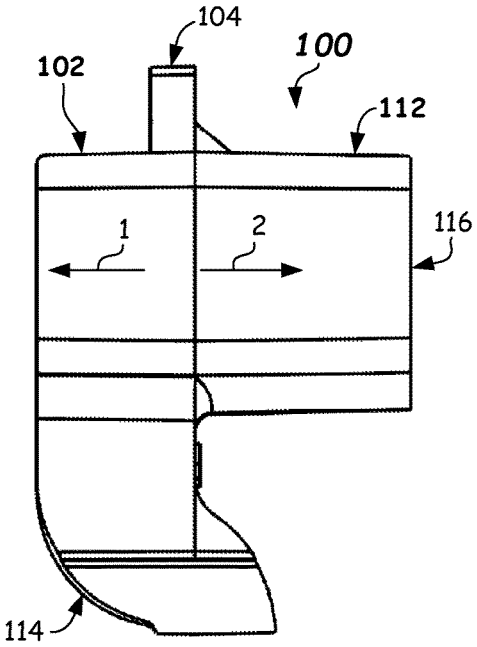
FIG. 1F illustrates a left side plan view of an arc shield apparatus according to embodiments.
Figure 1G:
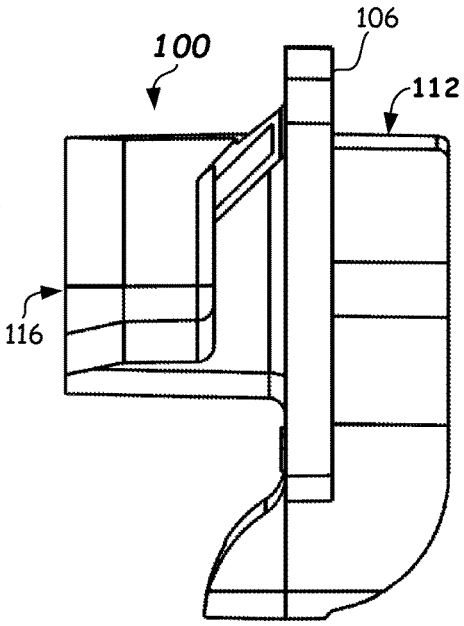
FIG. 1G illustrates a right side plan view of an arc shield apparatus according to embodiments.

As shown in FIG. 1F, the first shield portion 114 may extend away from the first side 106 of the abutting portion 104 in a first direction (in direction of arrow 1) and the second shield portion 116 may extend away from the second side 108 of the abutting portion 104 in a second direction (in a direction of arrow 2) opposite the first direction.

FIGS. 2A and 2B illustrate an example embodiment of a shielded contact arm assembly 200. Shielded contact arm assembly 200 includes a contact arm 201 including a pivot member 201P located on a first end 201A and the movable electrical contact 201C located at a second end 201B. The contact arm 201 constitutes a moveable arm in the electrical switching apparatus 300 (FIG. 3). The contact arm 201 includes the lateral side 205, the edge 209, and the spring tab 201ST located between the first end 201A and the second end 201B. Shielded contact arm assembly 200 includes an arc shield apparatus 100 including the aperture 110 that is received over the spring tab 201ST, the arc shield apparatus 100 abutting the contact arm 201 at a position proximate to the second end 201B and is moveable with the contact arm 201. Shielded contact arm assembly 200 further includes a contact arm spring 203 including the spring hook 203SH secured to the spring tab 201ST and retaining the arc shield apparatus 100 on the contact arm 201, wherein the arc shield apparatus 100 is configured to shield the contact arm 201 from arc debris and erosion during an arcing event. The arc shield apparatus 100 may also be configured to shield the spring hook 203SH and also the spring tab 201ST from arc debris and erosion during an arcing event.

FIG. 3 illustrates an example embodiment of an electrical switching apparatus 300 including the arc shield apparatus 100 and the shielded contact arm assembly 200 described herein. Only the components interfacing with the shielded contact arm assembly 200 are shown. The other components such as the load terminal, load conductor, armature, and bimetal/magnet element are not shown and are conventional. The electrical switching apparatus 300 includes a molded case 316 (only a part shown), an operating handle 318 moveable relative to the molded case 316 and operable to open and close the electrical contacts comprising a stationary electrical contact 320 and the movable electrical contact 201C. The stationary electrical contact 320 may be directly coupled to a line connector 322, such as a stab connector in some embodiments. Electrical switching apparatus 300 may include a cradle 324, wherein the contact arm spring 203 is coupled between the cradle 324 and the spring tab 201ST. The arc shield apparatus 100 is installed on the contact arm 201 may shield the contact arm 201 and spring hook 203SH from arcing and arc debris directed in the direction of arrow A which is the approximate direction of the arcing and arc debris projection upon opening (i.e., separation of) the stationary electrical contacts 230 and movable electrical contact 201C.

Figure 5:
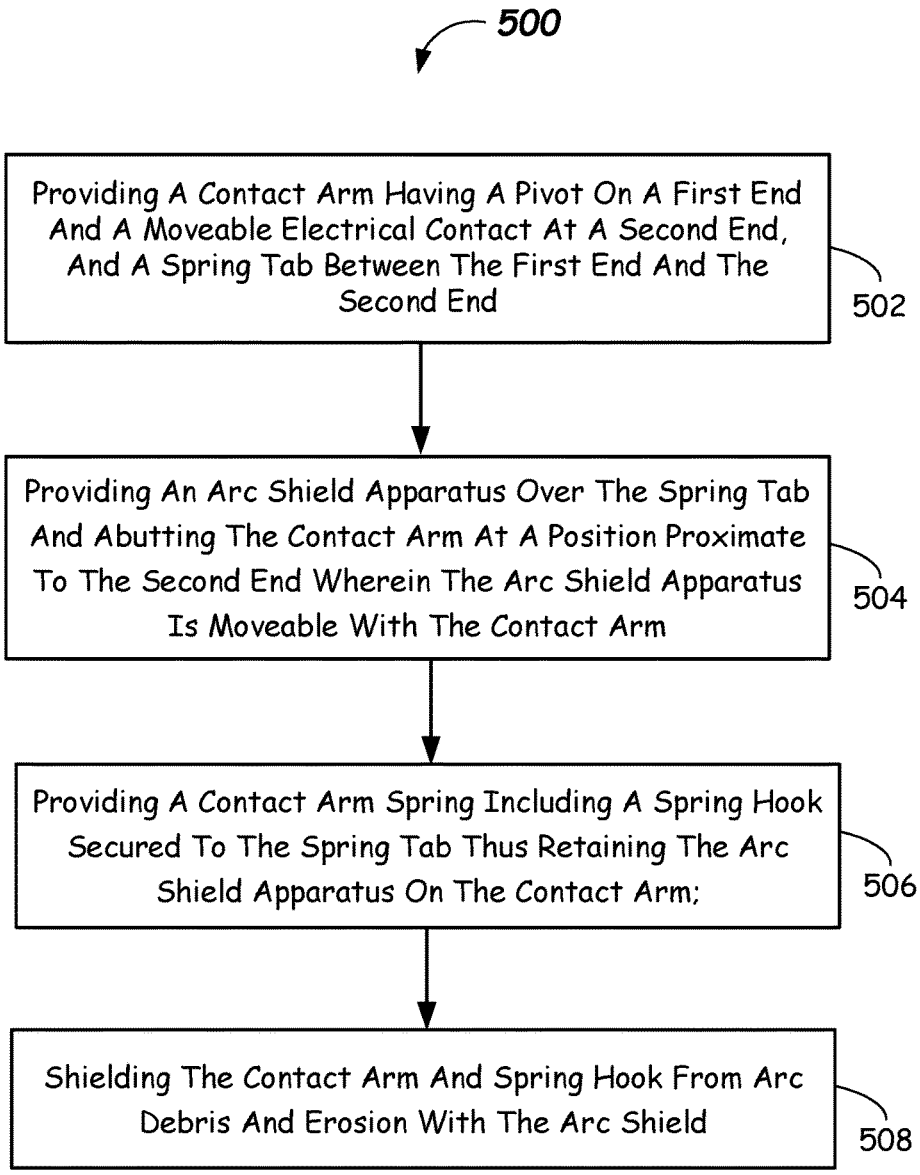
FIG. 5 illustrates a flowchart of a method of protecting a contact arm of an electrical switching device during an arcing event according to embodiments.

FIG. 5 is a flowchart that illustrates a method 500 of protecting a contact arm (e.g., contact arm 201) of an electrical switching device (e.g., electrical switching apparatus 300, such as a circuit breaker) during an arcing event according to embodiments. The method 500 includes, in 502, providing a contact arm (e.g., contact arm 201) having a pivot member (e.g., pivot member 201P) on a first end (e.g., first end 201A) and a moveable electrical contact (e.g., movable electrical contact 201C) on a second end (e.g., second end 201B), and a spring tab (e.g., spring tab 201ST) located between the first end (e.g., first end 201A) and the second end (e.g., second end 201B).

The method 500 includes, in 504, providing an arc shield apparatus (e.g., arc shield apparatus 100) over the spring tab (e.g., spring tab 201ST) and abutting the contact arm (e.g., contact arm 201) at a position proximate to the second end (e.g., second end 201B) wherein the arc shield apparatus (e.g., arc shield apparatus 100) is moveable with the contact arm (e.g., contact arm 201).

The method 500 includes, in 506, providing a contact arm spring (e.g., contact arm spring 203) including a spring hook (e.g., spring hook 203SH) secured to the spring tab (e.g., spring tab 201ST) and retaining the arc shield apparatus (e.g., arc shield apparatus 100) on the contact arm (e.g., contact arm 201), and, in 508, shielding the contact arm (e.g., contact arm 201) and spring hook (e.g., spring hook 203SH) from arc debris and erosion with the arc shield apparatus (e.g., arc shield apparatus 100).

Specific apparatus and assembly embodiments and methods thereof have been shown by way of example in the drawings and are described in detail herein. It should be understood, however, that it is not intended to limit the disclosure to these particular apparatus, assemblies, or methods, but, to the contrary, the intention is to cover all modifications, equivalents, and alternatives falling within the scope of the appended claims.

What is claimed is:

1. An arc shield apparatus, comprising:

a body including:

an abutting portion including a first side configured to abut against a lateral side of a contact arm of an electrical switching device, and a second side opposite from the first side, an aperture passing between the first side and the second side, the aperture configured to receive a spring tab of the contact arm therein; and a shield including a first shield portion extending from the abutting portion, the first shield portion including a first contact surface configured to abut against an edge of the contact arm, and a second shield portion extending from the abutting portion and configured to shield at least some of the spring tab and spring hook, wherein the aperture comprises a rectangular shape.

2. The arc shield apparatus of claim 1, wherein the first side of the abutting portion comprises a planar surface.

3. The arc shield apparatus of claim 1, wherein the first shield portion extends perpendicularly from a planar surface of the first side.

4. The arc shield apparatus of claim 1, wherein the first shield portion extends from the first side of the abutting portion in a first direction, and the second shield portion extends from the second side of the abutting portion in a second direction opposite the first direction.

5. The arc shield apparatus of claim 1, wherein the body comprises a molded polymer body.

6. The arc shield apparatus of claim 5, wherein the molded polymer body comprises a polyphenylene sulfide material.

7. An arc shield apparatus, comprising:

a body including:

an abutting portion including a first side configured to abut against a lateral side of a contact arm of an electrical switching device, and a second side opposite from the first side, an aperture passing between the first side and the second side, the aperture configured to receive a spring tab of the contact arm therein; and a shield including a first shield portion extending from the abutting portion, the first shield portion including a first contact surface configured to abut against an edge of the contact arm, and a second shield portion extending from the abutting portion and configured to shield at least some of the spring tab and spring hook, wherein the second shield portion extending from the second side of the abutting portion comprises a first shield wall and a second shield wall that are angularly oriented to one another.

8. The arc shield apparatus of claim 7, wherein an angular orientation angle $\phi$ between the first shield wall and the second shield wall is between 90 degrees and 130 degrees.

9. The arc shield apparatus of claim 7, wherein the body comprises a molded polymer body.

10. The arc shield apparatus of claim 9, wherein the molded polymer body comprises a polyphenylene sulfide material.

11. A shielded contact arm assembly, comprising:

a contact arm including a pivot on a first end and a moveable electrical contact at a second end, a lateral side, an edge, and a spring tab located between the first end and the second end;

an arc shield apparatus including an aperture received over the spring tab, the arc shield apparatus abutting the contact arm at a position proximate to the second end and moveable with the contact arm; and a contact arm spring including a spring hook secured to the spring tab and retaining the arc shield apparatus on the contact arm, wherein the arc shield apparatus is configured to shield the contact arm and the spring hook from arc debris and erosion during an arcing event, wherein a first shield portion extends from an abutting portion in a first direction and a second shield portion extends from a second side in a second direction opposite the first direction, and wherein the second shield portion extending from the second side of the abutting portion comprises a first shield wall and a second shield wall that are angularly oriented to one another.

12. The shielded contact arm assembly of claim 11, wherein the arc shield apparatus comprises:

a body having:

the abutting portion including a first side abutting the lateral side of the contact arm, and a second side opposite from the first side, the aperture passing between the first side and the second side; and the arc shield apparatus including the first shield portion extending from the abutting portion, the first shield portion including a first contact surface configured to abut the edge, and the second shield portion extending from the abutting portion and configured to shield the spring tab and spring hook.

13. The shielded contact arm assembly of claim 12, wherein the first side of the abutting portion comprises a planar surface.

14. The shielded contact arm assembly of claim 12, wherein an angular orientation angle $\phi$ between the first shield wall and the second shield wall is between 90 degrees and 120 degrees.

15. The shielded contact arm assembly of claim 12, wherein the body comprises a molded polymer body.

16. The shielded contact arm assembly of claim 15, wherein the molded polymer body comprises a polyphenylene sulfide material.

* * * * *